United States Patent [19]

Nakazato

[11] 3,942,564

[45] Mar. 9, 1976

[54] FUEL TANK FILLING INLET PORT DEVICE

[75] Inventor: Tunoru Nakazato, Chigasaki, Japan

[73] Assignee: Nissan Motor Company Limited, Yokohama, Japan

[22] Filed: July 10, 1974

[21] Appl. No.: 487,023

[30] Foreign Application Priority Data

July 13, 1973 Japan ..... 48-83205

[52] U.S. Cl. ..... 141/348; 141/311 R

[51] Int. Cl.[2] ..... B65B 3/04

[58] Field of Search ..... 141/97, 192, 198, 286, 141/311, 325, 346–351, 369, 370, 372, 378, 392; 220/86 R; 137/588; 251/149.2

[56] References Cited

UNITED STATES PATENTS

| | | | |
|---|---|---|---|
| 3,580,414 | 5/1971 | Ginsburgh et al. | 220/86 R |
| 3,730,216 | 5/1973 | Arnett et al. | 220/86 R |
| 3,815,784 | 6/1974 | Hansel | 141/351 X |

*Primary Examiner*—Richard E. Aegerter
*Assistant Examiner*—Frederick R. Schmidt

[57] ABSTRACT

A fuel inlet port with a recess formed therein allows a smaller diameter filling gun to discharge lead free fuel, but prevents the discharge of lead containing fuels from a larger diameter gun.

5 Claims, 3 Drawing Figures

FUEL TANK FILLING INLET PORT DEVICE

The present invention relates generally to a fuel tank for use in a motor vehicle and particularly to a fuel inlet port of a fuel tank in a motor vehicle.

Motor vehicles have been recently equipped with catalytic converters for purifying exhaust gases emitted from an engine of the vehicle. Thus, the vehicles are required to use a lead free fuel, in order to avoid contamination of the catalyst in the catalytic converters. In order to avoid such vehicles receiving lead containing fuel, it has been proposed to use a fuel supply inlet port and nozzle of a fuel tank and fuel feeding gun, respectively, for motor vehicles of this type, smaller in diameter than those of a fuel tank and a fuel feeding gun for motor vehicles which use a fuel containing lead. This makes it impossible to insert the nozzle of the fuel feeding gun for a fuel which contains lead into the fuel supply inlet port of the fuel tank in which the fuel is lead free. However, even if a fuel tank thus constructed is provided in a motor vehicle equipped with a catalytic converter, there is still the possibility that the fuel tank will be intentionally or unknowingly supplied with a fuel which contains lead.

It is, therefore, an object of the invention to eliminate the above-mentioned shortcomings encountered in the prior art by providing an improved fuel tank filling inlet port device for a motor vehicle employing an unleaded fuel.

This and other objects and advantages of the invention will become more apparent from the following detailed description taken in connection with the accompanying drawings in which.

Figure 1:
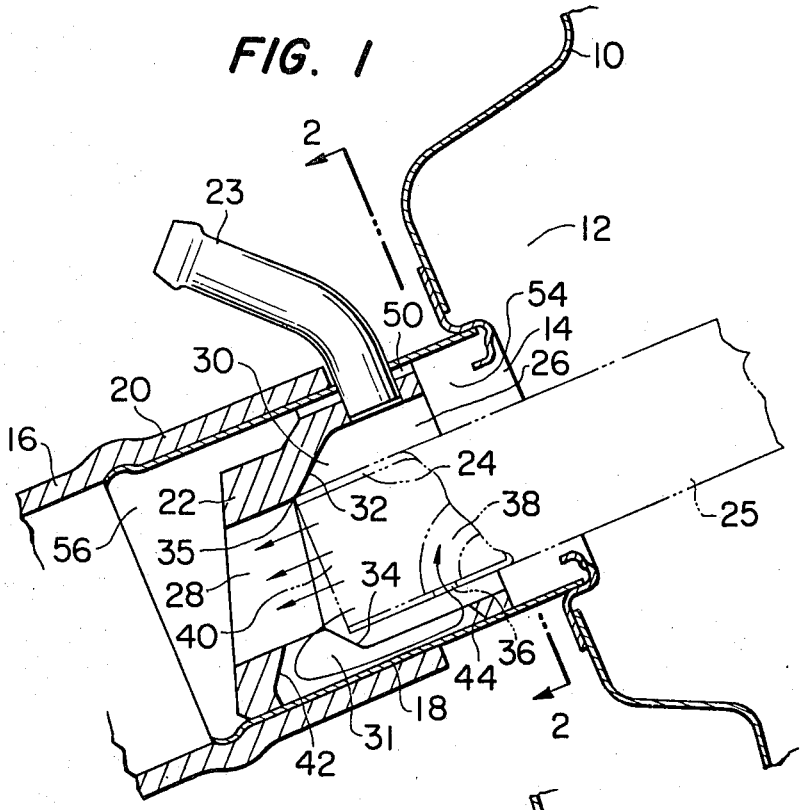
FIG. 1 is a schematic cross sectional view showing a first preferred embodiment of a fuel tank filling inlet port device according to the invention.
Figure 2:
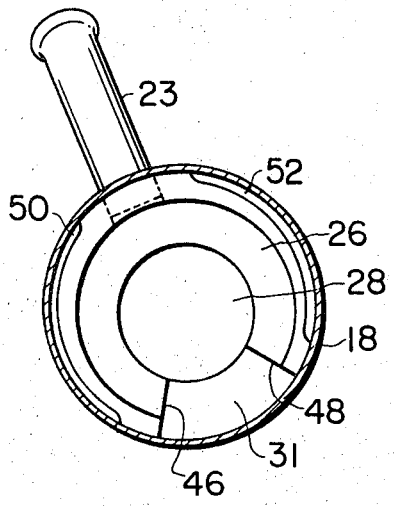
FIG. 2 is a schematic cross sectional view taken substantially along a line 2—2 of FIG. 1.

FIGS. 1 and 2 illustrate a first embodiment of the invention. Referring now to FIG. 1, a portion of a motor vehicle (no numeral) is shown to include an external structural member 10 of the vehicle such as a fender, a recess 12 is formed in the external structural member 10, a fuel filler opening 14 is formed through the recess 12, and a fuel filler outer tube 16 opens from the vicinity of the filler opening 14 into the interior of an unleaded fuel tank (not shown) provided in the vehicle. A fuel filler inner tube 18 communicates with the filler opening 14 and is fixedly fitted in an outer end portion 20 of the outer tube 16. A fuel filler insert 22 is fixedly inserted into the inner tube 18, a vent tube 23 communicates at one end thereof with the interior of the insert 22 and at the other with the interior of the vehicle. A nozzle 24 of a first fuel feeding gun 25 for feeding a fuel which contains lead is shown as being inserted into the insert 22. The filler opening 14 is covered by a suitable cap member (not shown) after filling of the fuel tank. The nozzle 24 of the first fuel feeding gun 25 has a cross sectional area of a first predetermined value and is greater in cross sectional area than a nozzle, of a second fuel feeding gun (not shown) for feeding a fuel which contains no lead, which has a cross sectional area of a second predetermined value. The insert 22 has formed therein first, second and third bores 26, 28 and 30, respectively, which communicate with each other and a recess 31 formed in and opening into the bores 26, 28 and 30. The first bore 26 is opposite to the filler opening 14, the second bore 28 is opposite to the fuel tank and the third bore 30 is formed between the first and second bores 26 and 28. The first bore 26 has a cross sectional area larger than the first predetermined value to allow passage of the nozzle 24 of the first fuel feeding gun 25 into the first bore 26, as shown in FIG. 1. The second bore 28 is of a circular cross sectional shape having a cross sectional area smaller than the first predetermined value and greater than the second predetermined value to inhibit passage of the nozzle 24 of the first fuel feeding gun 25 through the second bore 28 and allow passage of the nozzle of the second fuel feeding gun therethrough. However, said second bore may also be any suitable cross sectional shape other than a circle such as an ellipse so that the second bore 28 allows insertion of the nozzle of the second fuel feeding gun thereinto and refuse insertion of the nozzle 24 of the first fuel feeding gun 25. The third bore 30 is gradually reduced in its cross sectional area or in its diameter toward the second bore 28 so that the wall surfaces 32 and 34 defining the third bore 30 taper off toward the second bore 28. The upper wall surface 32 is vertically above the lower wall surface 34. As a result, the upper wall surface 32 serves in such a way that, when the nozzle 24 of the first gun 25 is inserted into the third bore 30 and abuts against the upper wall surface 32, the nozzle 24 slides downwardly and obliquely along the upper wall surface 32 until an upper edge of an end of the nozzle 24 contacts an upper intersection 35 between the wall surfaces of the second and third bores 28 and 30, and a lower edge of the end of the nozzle 24 abuts against the lower wall surface 34 so that a portion of an end opening 40 of the nozzle 24 is located in the recess 31. The nozzle 24 of the first gun 25 has formed through its side wall a hole 36 opening into the open air and a conduit 38 communicates with the hole 36 and leads to an automatic stop or shut off mechanism (not shown) of the first gun 25. Such a hole 36, conduit 38 and automatic stop mechanism of a first fuel feeding gun 25 serve in such a way that, when a leaded fuel tank is filled by the first fuel feeding gun, fuel flows toward the automatic stop mechanism through the hole 36 and conduit 38. Thus, the automatic stop mechanism is operated to automatically stop further discharge of the fuel from the first gun into the leaded fuel tank. The hole 36 is located to be opposite the recess 31 as shown in FIG. 1. The recess 31 is formed through the first, second and third bores 26, 28 and 30 on the lower sides thereof through a suitable angle as shown in FIG. 2 and has opposite inner and outer ends 42 and 44 and opposite sides 46 and 48. The recess 31 forms a path of fluid flow from the nozzle 24 of the first fuel feeding gun 25 to the hole 36 when the nozzle 24 of the first fuel feeding gun 25 is inserted into the third bore 30 through the first bore 26 to feed fuel to the fuel tank. A portion of the fuel discharged from the nozzle 24 inserted into the third bore flows into the recess 31 and is directed toward and strikes against the inner end 42, as shown in FIG. 1. The inner end 42 serves to deviate the flow of fuel striking thereagainst towards the outer end 44. The flow of fuel thus deviated by the inner end 42 flows in the recess 31 and strikes against the outer end 44. The outer end 44 serves to deviate the flow of fuel striking thereagainst toward the hole 36 of the nozzle 24. To fulfil this functions, the ends 42 and 44 extend diagonally toward a longitudinal axis of the insert 22 and toward each other, as shown in FIG. 1. The flow of fuel thus deviated by the outer end 44 flows into the conduit 38 through the hole 36 and actuates the automatic stop mechanism to cause the first gun to stop discharge of the fuel. The insert 22 has formed at its outer circumferential portion a pair of passages 50 and 52 communicating the upstream and downstream parts 54 and 56 of the insert 22. The passages 50 and 52 serve to channel or bypass into the fuel tank fuel flowing from the recess 31 into the first and third bores 26 and 30 and also serve to pass air within the fuel tank into the atmosphere during filling of the fuel tank by the second gun. The opposite sides 46 and 48 of the recess 31 are preferably directed toward one of the axes of the bores 26, 28 and 30, as shown in FIG. 2 so that the fuel is not scattered when striking against the ends 42 and 44.

Figure 3:
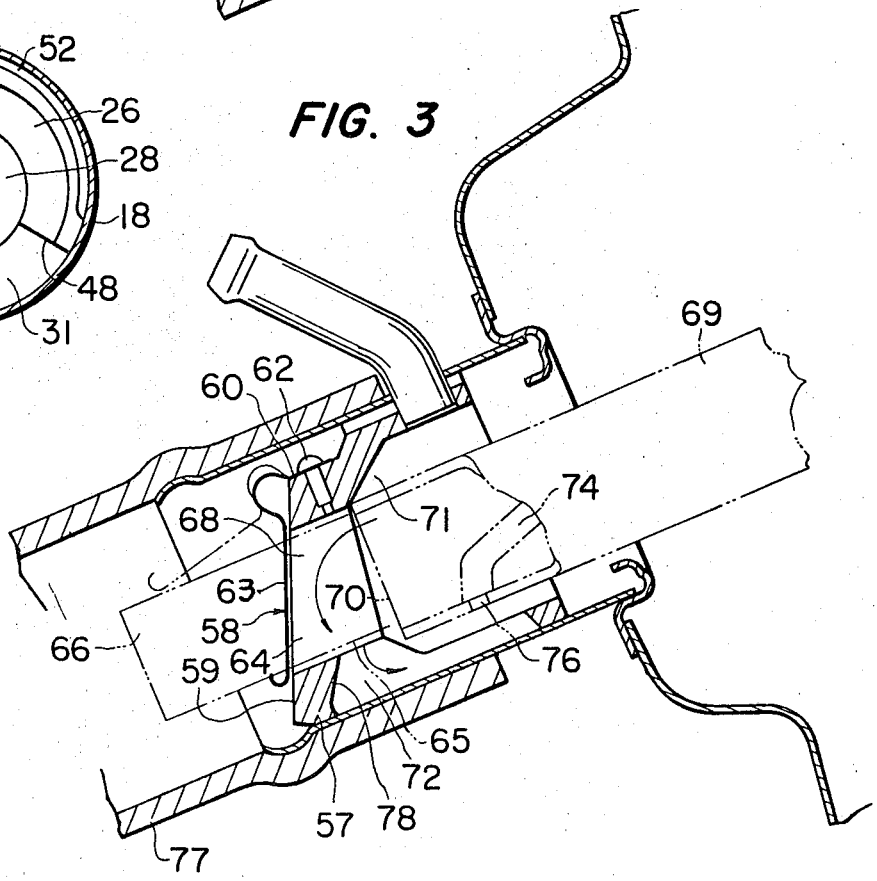
FIG. 3 is a schematic cross sectional view showing a second preferred embodiment of a fuel tank filling inlet port device according to the invention.

FIG. 3 illustrates a second embodiment of the invention. The embodiment of FIG. 3 is different from the embodiment of FIG. 1 in that a plate valve member 58 is mounted or seated on an inner end portion 59 of the insert 57. The plate valve member 58 is made of a leaf spring material and has one section 60 fixedly secured to the insert 57 through a screw 62 and the other section 63 seated on the inner end portion 59 to close an inner end opening 64 of the insert 57. The section 63 of the valve member 58 can be swinged or opened by a nozzle 66 of a second fuel feeding gun 65 to allow the nozzle 66 to pass through a second bore 68 of the insert 57, as shown in phantom lines in FIG. 3. The section 63 of the valve member 58 is seated on the inner end portion 59 by the resilient force of the valve member 58 when the second gun 65 is extracted from the insert 57. The section 63 of the valve member 58 cannot be opened by fuel discharged from a nozzle 70 of a first fuel feeding gun 69 inserted into a third bore 71 of the insert 57 and therefore remains seated on the inner end portion 59 of the insert 57. Since the fuel discharged from the nozzle 70 of the first gun 69 strikes against the plate valve member 58 and is deviated thereby in an opposite direction to flow into a recess 72 to increase the amount of fuel which flows into the conduit 74 of the nozzle 70 through a hole 76 similar to the case of FIG. 1, an automatic stop mechanism of the first gun 69 is operated to stop the discharge of fuel from the first gun 69 more quickly than the case of FIG. 1. Simultaneously, the amount of leaded fuel fed into an unleaded fuel tank (not shown) from the first gun 69 is reduced to zero. The provision of the plate valve member 58 on the insert 57 is remarkably effective in the case that the fuel filler outer tube 77 is steeply inclined and accordingly the force of the flow of fuel diverted by an inner end 78 of the recess 72 is relatively weak and that the speed of flow of fuel discharged from the first gun 69 is relatively low.

It is thus appreciated that the introduction of a fuel containing lead into a fuel tank of a motor vehicle required to employ a lead free fuel can be prevented or greatly reduced by providing a fuel filler inlet port device having greater, conical and smaller bores and a recess formed in the bores to divert fuel which has flowed into the recess from a first gun toward a hole of a nozzle of the first gun by opposite ends of the recess, or in addition by providing a resilient plate valve member on an inner end portion of the inlet port device.

What is claimed is:

1. A fuel filling inlet port device for a fuel tank in a motor vehicle, comprising a wall defining therein a first bore communicating with the outside atmosphere and having a cross sectional area larger than a first predetermined value, a second bore communicating with a fuel tank of a motor vehicle and having a cross sectional area smaller than said first predetermined value and larger than a second predetermined value, a third bore located between said first and second bores and tapered off from said first bore toward said second bore, and a recess communicating with said first, second and third bores and, when a nozzle, of a first fuel feeding gun, having a cross sectional area of said first predetermined value is inserted into said third bore through said first bore to feed fuel to said fuel tank, said recess forms a path of fluid flow from said nozzle to a hole in the side of said nozzle connected to a shut off mechanism of said fuel feeding gun, said recess having one end adjacent said second bore and the other end remoter from said fuel tank than said one end, fuel from said nozzle striking against said one end and being then diverted thereby toward said other end, said fuel diverted by said one end striking against said other end and being then diverted thereby to said hole in said nozzle.

2. A fuel filling inlet port device as claimed in claim 1, in which said wall has an inner end portion through which said second bore is formed, and further comprising a resilient plate valve member seated on said inner end portion of said wall, said valve member, when a nozzle, of a second fuel feeding gun, having a cross sectional area of said second predetermined value is inserted into said second bore through said first and third bores, being openable by said nozzle of said second fuel feeding gun and being unopenable by fuel from said nozzle of said first fuel feeding gun inserted into said third bore.

3. A fuel filling inlet port device as claimed in claim 2, in which said first fuel feeding gun is employed for a lead containing fuel and said second fuel feeding gun is employed for a lead free fuel.

4. A fuel filling inlet port device as claimed in claim 1, in which said one end and said other end of said recess each extend obliquely toward a longitudinal axis of said inlet port device to converge towards each other.

5. A fuel filling inlet port device as claimed in claim 1, in which opposite sides of said recess each extend toward a longitudinal axis of said inlet port device.

* * * * *